United States Patent [19]

Krupp

[11] 4,252,161

[45] Feb. 24, 1981

[54] SUPPORT FOR GASOLINE PUMP

[75] Inventor: Carroll P. Krupp, Akron, Ohio

[73] Assignee: The B. F. Goodrich Company, Akron, Ohio

[21] Appl. No.: 2,912

[22] Filed: Jan. 12, 1979

[51] Int. Cl.[3] ..... B65B 3/04; B67D 5/06

[52] U.S. Cl. ..... 141/279; 137/355.16; 137/355.24; 141/392; 222/530; 222/538

[58] Field of Search ..... 137/355.17, 355.16, 137/355.24, 355.23; 138/133, 132; 141/59, 98, 279, 284, 387, 388, 382, 392; 222/74, 75, 527, 529, 530, 538

[56] References Cited

U.S. PATENT DOCUMENTS

| | | | |
|---|---|---|---|
| 2,741,267 | 4/1956 | McKinley | 138/133 |
| 2,930,514 | 3/1960 | Pacey | 222/530 |
| 3,980,112 | 9/1976 | Basham | 141/392 |
| 4,131,218 | 12/1978 | Tatsuno | 222/527 |

*Primary Examiner*—Frederick R. Schmidt
*Attorney, Agent, or Firm*—Joseph Januszkiewicz

[57] ABSTRACT

A mast for use on a gasoline pump or pedestal wherein one end of a fuel dispensing coaxial hose is supported by the mast while the other end of the coaxial hose has a nozzle connected thereto. The nozzle has a boot which collects the vapors for conveyance back to the coaxial hose while the nozzle dispenses the gasoline. The mast supports the coaxial hoses in a vertical attitude and permit the pivoting of the hoses about a vertical axis which prevents twisting or kinking of the coaxial hoses since it rotates inside of the mast and has means for assuring continuous passage of the vapors and the liquid fuel without interruption during manipulation of the fuel dispensing coaxial hose and nozzle.

7 Claims, 5 Drawing Figures

FIG. 4
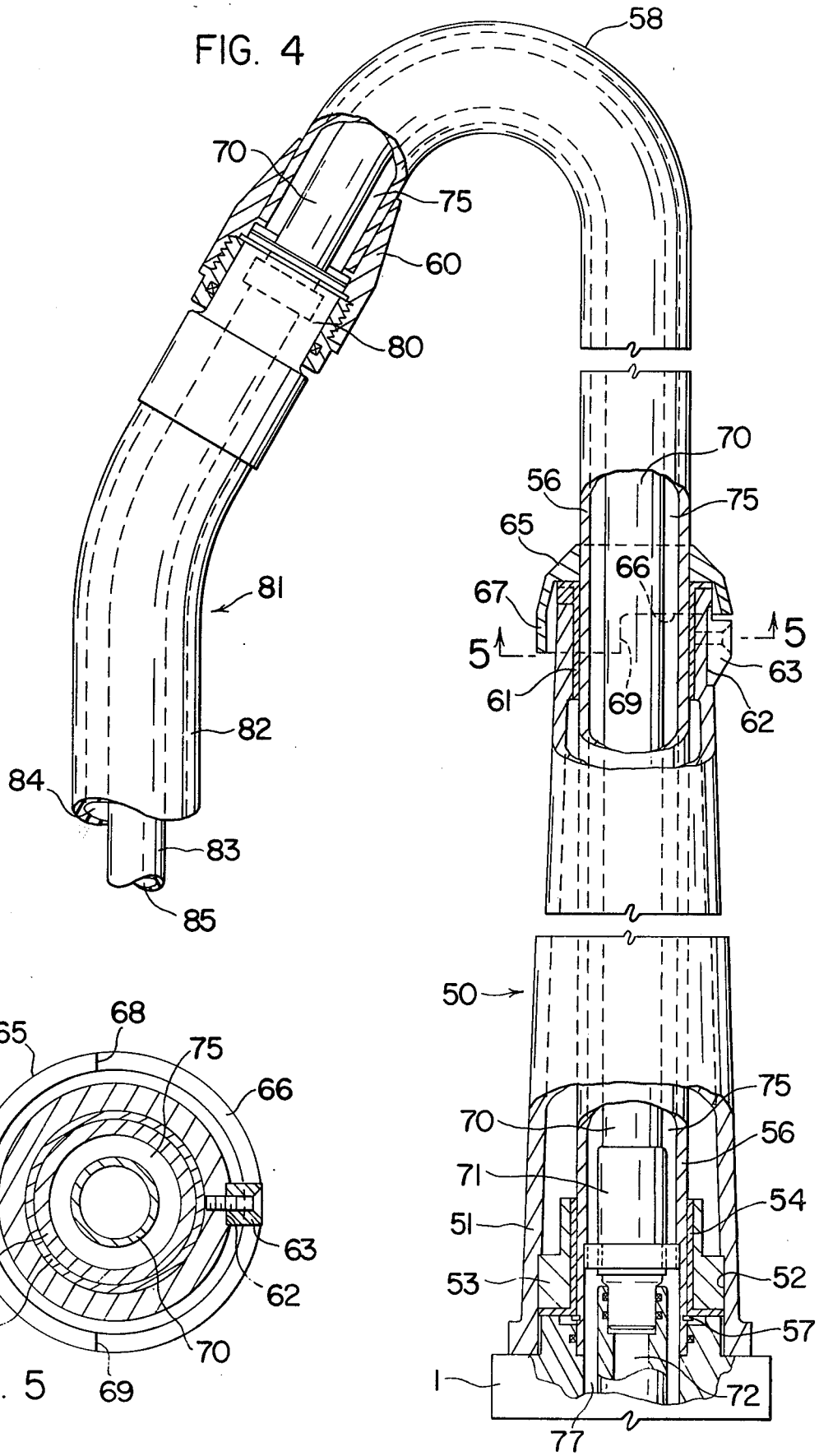
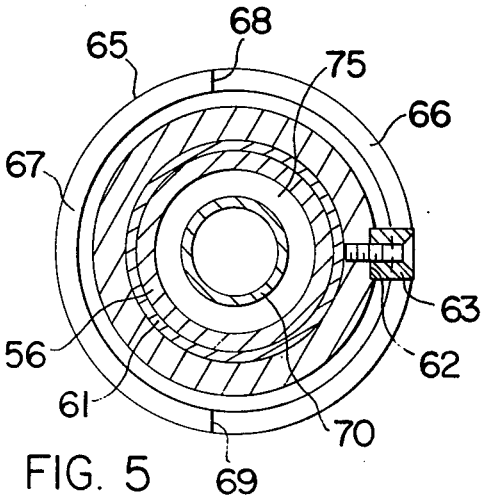
FIG. 5

SUPPORT FOR GASOLINE PUMP

BACKGROUND OF THE INVENTION

This invention relates to a vapor recovery system utilizing a dual hose system and more particularly to the hose dispensing means for the dispensing of gasoline to a vehicle while recovering vapors therefrom.

There has been increased emphasis on preventing pollution to the air of the atmosphere from the filling of vehicle fuel tanks. Vapor recovery systems have been devised for service station's storage facilities which use the present tanks that are below the ground level, dispenses the liquid fuel such as gasoline into the tank of a vehicle, while a concentric tube on the fuel dispensing hose collects the vapors displaced from the vehicle tank and conveys the fuel vapors back into the storage tank. In order to facilitate the task of dispensing fuels a special dispensing nozzle is used, such that it can collect the vapors from the vehicle tank and direct them outwardly to a hose adjacent to the dispensing hose. In addition to making these hoses parallel and adjacent, the dispensing hose can utilize concentric hoses, with the inner hose being the dispensing hose and the other concentric annular space being the vapor collecting and dispensing hose. When utilizing hose of the concentric type, in the gasoline station, twisting or kinking of the hose occurs when manuvering and positioning the hose for use in dispensing fuel or gasoline to vehicles because of the manner in which these vehicles park relative to the dispensing gasoline pump in the service station. This has been compounded by the self-service station type where the person dispensing the gasoline is not particularly careful in the manner in which he manipulates the hose. Considerable attention must be given by an attendant to untwist or unkink the hose periodically.

The present invention overcomes these difficulties by mounting the coaxial hose in a vertically extending support or mast which allows pivotal movement of the concentric hoses about a vertical axis thus permitting the movement of the hose dispensing nozzle and the coaxial hoses from one side of the pump to the other side of the pump without twisting the hoses. It also permits the mounting of two coaxial hoses adjacent to each other on a single pump without the problem of cross-over or interlocking of the hoses. The coaxial hose is adaptable for use in a flexible mast or in a rigid type mast that permits the servicing of vehicles that are parked for receiving gasoline at relatively considerable distances from the pump yet prevent the kinking of the hose. In addition, the present hose reduces the weight that has ordinarily been associated with coaxial fuel hose dispensing means.

SUMMARY OF THE INVENTION

According to the present invention, a fuel dispensing hose assembly comprising a coaxial hose with a fuel dispensing nozzle and vapor collecting means thereon is connected to a fuel dispensing pump orpedestal via a flexible yieldable mast which supports the coaxial hose for pivotal movement about a vertical axis to assure continuous flow without kinking or twisting even though the fuel dispensing coaxial hose is moved over a large radius and manipulated into different positions of use. Alternatively the mast may be a rigid member that is moveable through a predetermined arc.

BRIEF DESCRIPTION OF THE DRAWINGS

FIG. 4 is an enlarged partial section, partial elevational view of a portion of the mast type dispensing concentric hose of a modified form of the invention.

FIG. 5 is a cross-sectional of the mast and coaxial hose taken in line 5—5 of FIG. 4.

DETAILED DESCRIPTION

Figure 1:
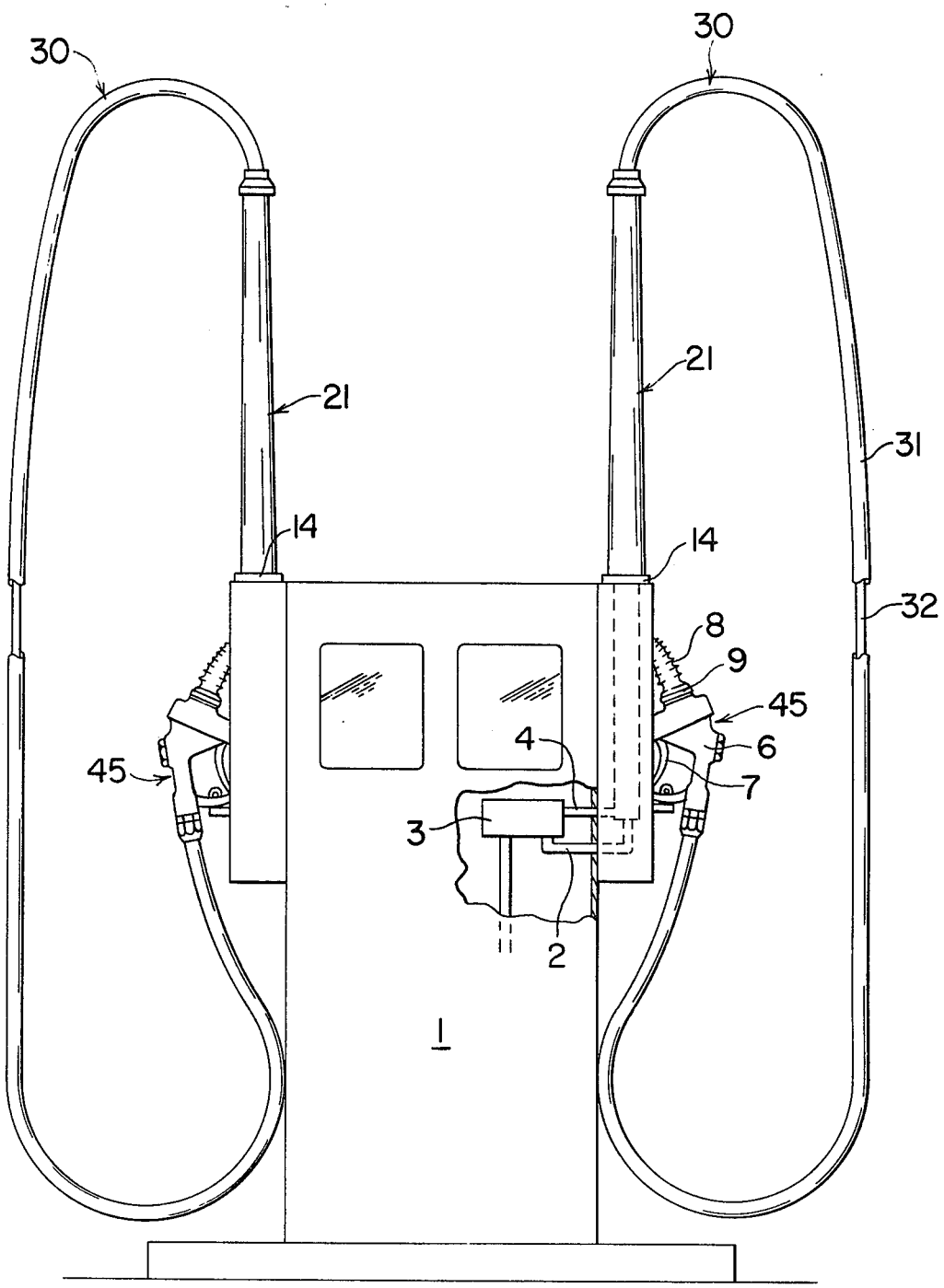
FIG. 1 is a front elevational view of a service station liquid fuel dispensing pump utilizing a hose of the present invention.

Referring to the drawings wherein like reference numerals designate like or corresponding parts throughout the several views, there is shown in FIG. 1 a pedestal 1 that houses a conduit 2 that is suitably connected via a control valve 3 to a suitable underground tank not shown, through which conduit 2 gasoline can be pumped. Pedestal 1 also houses a conduit 4 that is also connected to the control valve 3 and thence to the storage tank for returning vapors into either the storage tank or a suitable vapor recovery means.

A bushing 14 is suitably mounted on the upper end portion of pedestal 1. Suitably attached to bushing 14 as by a press fit is a base member or base assembly 15. Base member 15 is a generally tubular member 16 with its upper portion 17 being necked-down or of a reduced diameter relative to lower portion thereof. The outer surface of necked-down upper portion 17 has a spiral groove 18 to receive a spring 20 to be described.

An elongated molded rubber tube 21 operating as a flexible, yieldable mast is suitably attached at its base to bushing 14. A coil spring 20 is molded into the side wall portions of the intermediate portion of the tube 21, however the lower portion 22 and the upper portion 23 of the molded tube 21 only encompasses the outer surface or one-half of the spring 20. The lower portion 22 cooperates with the necked-down portion 17 of base member 15 to fully encompass and captively engage the lower portion of spring 20 while the upper portion 23 of tube 21 cooperates with a flanged sleeve or tubular member 25. Sleeve 25 is grooved on its inner peripheral surface such as to cooperate with the upper portion of tube 21 to fully encompass and captively engage the upper end of spring 20. To provide a greater stiffness to rubber tube 21, short fibers are calendered or extruded into tube 21 to provide an orientation that is directional to the longitudinal length of the tube 21.

A coaxial hose 30 having an outer hose 31 and an inner hose 32 defines an annular passageway 33 and an inner passageway 34. The base of hose 30 is secured to a swivel member 35 such that the inner hose 32 is connected to conduit 2 while the annular passageway 33 is connected to chamber 36 defined by the swivel member 35, base member 15 which in turn is connected to conduit 4 for recovering the fuel vapors for directing them either to the storage tank or a vapor recovery means.

In the normal storage position or in the normal use of the hose and fuel dispensing nozzle the coaxial hose 30 adjacent to the mast 21 and a portion that extends into such mast 21 assumes an arc of a gradual curve due to the placement of a spiral yieldable spring 40 therein.

The spring 40 is placed in the annular passageway 33 to prevent collapse of the annular passageway at the bend of the hose 30 and permits a greater degree of flexibility as the coaxial hose 30 is positioned for use into the fill opening of a vehicle fuel tank without kinking the hose as it is moved from the storage position to and from use. The spring 40 terminates in that portion of the hose 30 that is located in the upper portion of yieldable mast 21. A nylon bushing 41 is closely received by the clearance space provided between coaxial hose 30 and the sleeve 25 of the upper end of mast 21. The nylon bushing 41 permits the rotation of the coaxial hose 30 about the vertical axis of the mast 21. Although the mast 21 is shown as vertical, the resiliency of the mast 21 is such as to permit an inclination from the true vertical, however even in these instances the curved coaxial hose 30 is able to rotate freely about the mast 21 without kinking. A further advantage of this structure is that the spring 40 in cooperation with the mast 21 takes up a considerable portion of the weight of the hose 30 that is to be manipulated by the individual who is to position the fuel dispensing pose 30 and a nozzle 45 into position for filling the fuel tank of a vehicle.

A fuel dispensing pump nozzle 45 includes a discharge nozzle 5 connected to a valve housing 6 (FIG. 1). Valve housing 6 contains an inner tubular member controlled by a suitable switch or lever 7 that controls the flow of fuel such as gasoline from the conduit 2 to the dispensing or discharge nozzle 5. A resilient flexible boot or shroud 8 encompasses the nozzle 5 and has one end suitably connected to the valve housing 6 as by a suitable clamp means 9 thereby allowing the other end free to abuttingly contact the exterior of an inlet pipe 10 of an automobile gasoline tank to be filled. This arrangement of the flexible boot 8 permits the collection of fuel vapors from the automobile fuel tank as the liquid fuel fills the automobile tank and fuel vapors and displaced outward from the inlet pipe 10, thereby collecting or being directed to the annular chamber 11 formed by the boot 8 and the discharge nozzle 5. The valve housing 6 has a suitable passageway interconnecting the annular chamber 11 with the chamber 36 and the annular passageway 33 which communicates with the vapor recovery means or the storage tank.

A modification of the invention is shown in FIG. 4 wherein a rigid mast 50 is shown as suitably attached to a pedestal 1, which pedestal is similar in all respects to that of the previously described embodiment. The lower end portion 51 of mast 50 is recessed internally thereof as at 52 to receive a bushing housing 53 and a bushing 54. Journaled for rotation in bushing 54 is an elongated tube 56. Tube 56 is recessed at the lower end portion to receive a retaining ring 57 which allows tube 56 to rotate in bearing 54 but prevents its linear movement out of mast 50. Tube 56 has an arcuate or curved upper portion 58 which has a collar 60 suitably attached thereto as by brazing. Suitably mounted within the upper end portion of mast 50 is a flanged annular bearing 61 which rotatably contacts the tube 56, allowing such tube 56 to rotate relative thereto. The upper end portion of mast 50 is recessed as at 62 in which recess is mounted a key or stop member 63, projecting outwardly away from periphery surface of the mast 50 for a purpose to be described. A stop collar or abutment 65 is suitably connected as by brazing to tube 56, which collar 65 encompasses the upper end portion of mast 50. Collar 65 is a cylindrical shaped member with a cut away portion 66 thereby providing an abutment 67 with two stop surfaces 68 and 69 being operative to abuttingly engage stop member 63 to limit the rotation of tube 56 relative to the pedestal 1 and stationary mast 50.

Mounted within elongated tube 56 is a rigid tube or hose 70 concentric therewith. The lowermost end portion of tube 70 is journaled to a coupling member 71 which communicates the central passageway of such tube 70 to a passageway 72 in pedestal 1 which in turn communicates with a control valve which controls the pumping of gasoline into the tube or hose 70. Tube 70 has curved upper portion similar to hose or tube 56 such as to define an annular passageway 75 therebetween, such that lower portion of such annular passageway 75 communicates with an annular passageway 77 in the pedestal 1 which in turn is suitably connected via conduits to the vapor recovery system as of the fuel or gasoline dispensing system of a service station.

The curved upper end portions of tube 70 and 58 together with collar 60 are connected to a swivel joint 80 to which a flexible coaxial hose 81 is connected. Coaxial hose 81 has an outer flexible hose 82 that is cooperative with an inner flexible concentric hose 83 to define an annular passageway 84. Flexible hose 83 has its passageway 85 connected to the dispensing nozzle such as nozzle 5 of FIG. 3 while the passageway 84 is connected to the vapor collecting chamber of the fuel dispensing nozzle such as annular chamber 11 formed by the flexible boot 8 and the discharge nozzle 5.

Figures 2, 3:
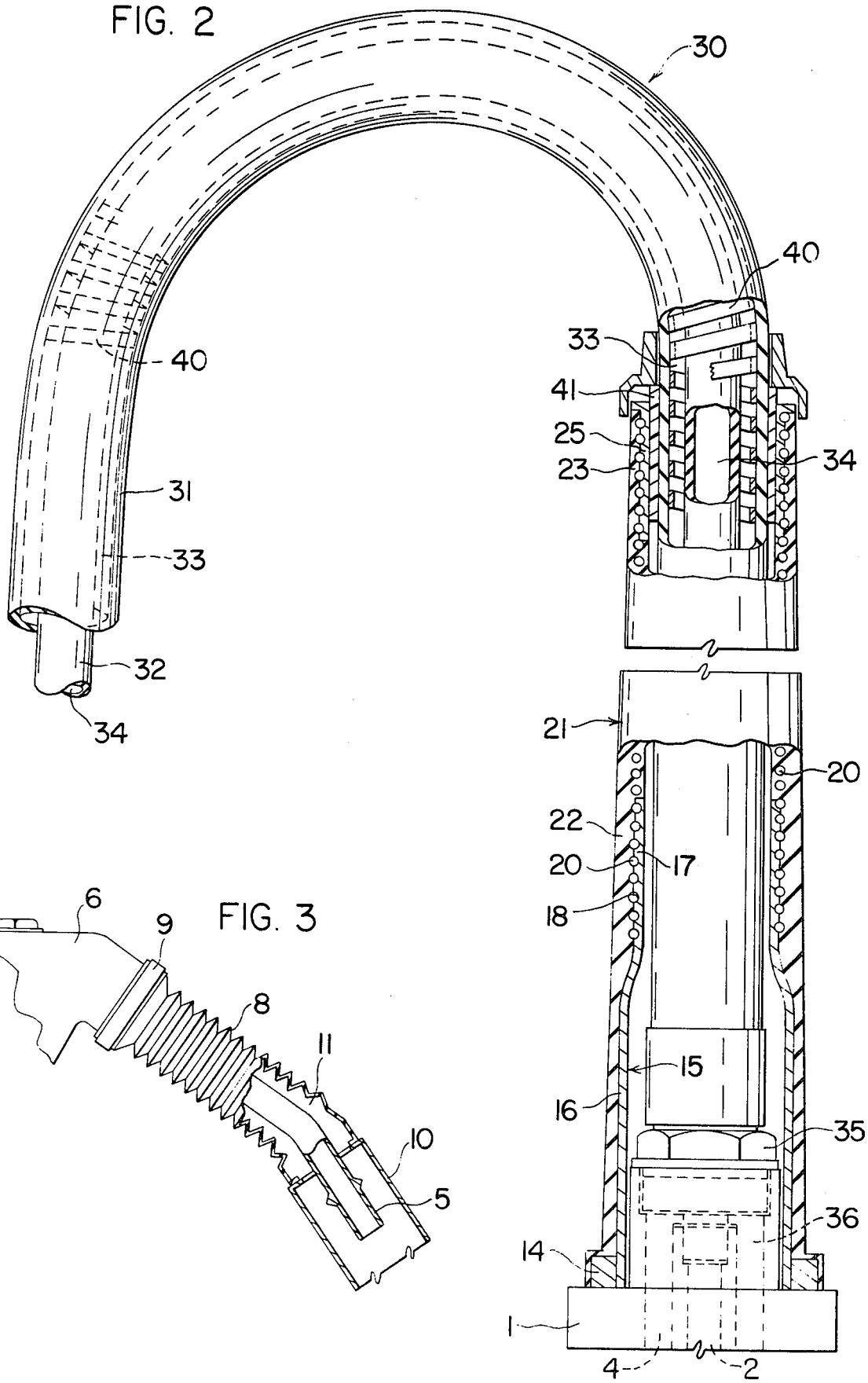
FIG. 2 is an enlarged partial sectional, partial elevational view of a portion of the mast type dispensing concentric hose.
FIG. 3 partly in section is a side elevational view of the end portion of a gasoline dispensing nozzle and intake pipe of a vehicle receptacle.

The operation of the modified form of the invention is substantially the same as in the embodiment shown in FIG. 2, therefore only one will be described. In the operation of the apparatus described, the operator removes the fuel dispensing nozzle 45 from the pedestal 1 and has considerable latitude in positioning the hose with its fuel dispensing nozzle 45 into the fuel inlet pipe on an automobile tank. In addition to the mast being flexible which permits it to bend to reach vehicles that are positioned a considerable distance from the gasoline pumpm or pedestal 1, the bushing 41 allows rotation of the coaxial hose freely to eliminate kinking and ease of dispensing. In addition the mast in cooperation with the spring 40 provides a spring loaded coaxial hose assembly which reduces the weight that an operator must carry in positioning the fuel dispensing nozzle 45. The mast of the embodiment shown in FIG. 1 is flexible and will bend, however; the mast 50 as well as the arcuate tube 58 in the embodiment shown in FIG. 4 is rigid, which thereby reduces the weight of the hose assembly, since it in effect supports and suspends the coaxial hose and fuel dispensing nozzle 45. To prevent interlocking or intertwining of the hoses or coaxial hoses on opposite sides of a pump, mast 50 has a stop collar 75 secured to outer tube or tube member 58 presenting two abutments or surfaces 68 and 69 which are adapted to selectively engage stop member 63 to prevent the further rotation of the rigid collar and tube member 58, thus limiting the rotative movement of the coaxial hoses.

Various modifications are contemplated and may obviously be resorted to by those skilled in the art without departing from the described invention, as hereinafter defined by the appended claims, as only preferred embodiments thereof have been disclosed.

I claim:

1. A fuel dispensing hose assembly for use with a fuel dispensing pedestal, said hose assembly having a flexible hollow tube member secured to said pedestal and extending generally vertically upward thereform, a spring member having a portion embedded in said tube member to provide resiliency to said tube member, a coaxial hose member having one end portion rotatably journaled in said pedestal and extending through said hollow tube member to provide a means for dispensing liquid fuel from a supply source to a receptacle, a fuel dispensing nozzle on the other end portion of said coaxial hose member, said coaxial hose member having an outer hose member and an inner hose member concentric with said outer hose member to provide an annular passageway therebetween, said pedestal having means for storing said nozzle in a storage non-use position which provides an arcuate curve to said coaxial hose adjacent to the upper portion of said hollow tube member, spring means located in said annular passageway of said coaxial hose between said inner hose member and said outer hose member to maintain said annular passageway, and said spring means in said coaxial hose extending from the upper portion of said hollow tube member to a point beyond said arcuate curve in said coaxial hose.

2. A fuel dispensing hose assembly as set forth in claim 1 wherein a bushing is frictionally received at the upper end portion of said hollow tube member between said coaxial hose and said hollow tube member to facilitate the rotation of said hose member, said spring member is embedded in the intermediate portion of said hollow tube member leaving said spring member partially embedded at the respective upper and lower end portions of said hollow tube member, and a hollow base member secured to the inner peripheral surface of said lower end portion of said hollow tube member.

3. A fuel dispensing hose assembly for use with a fuel dispensing pedestal, said hose assembly having a flexible hollow tube secured to said pedestal and extending generally vertically upward therefrom, a spring member having a portion embedded in said tube member to provide resiliency to said tube member, a coaxial hose member having one end portion rotatably journaled in said pedestal and extending through said hollow tube member to provide a means for dispensing liquid fuel from a supply source to a receptacle, a fuel dispensing nozzle on the other end portion of said coaxial hose member, said coaxial hose member having an outer hose member and an inner hose member concentric with said outer hose member, said pedestal having means for storing said nozzle in a storage non-use position which provides an arcuate curve to said coaxial hose adjacent to said hollow tube member, spring means located in said coaxial hose between said inner hose member and said outer hose member, said spring means in said coaxial hose extending from the upper portion of said hollow tube member to a point beyond said arcuate curve in said coaxial hose, a bushing is frictionally received at the upper end portion of said hollow tube member between said coaxial hose and said hollow tube member to facilitate the rotation of said hose member, said spring member is embedded in the intermediate portion of said hollow tube member leaving said spring member partially embedded at the respective upper and lower end portions of said hollow tube member, a hollow base member secured to the inner peripheral surface of said lower end portion of said hollow tube member, and said hollow base member has a threaded upper outer surface portion that complementary receives said spring member of said lower end portion of said hollow tube member.

4. A fuel dispensing hose assembly as set forth in claim 3 wherein a rigid tubular member is interposed between said bushing and said hollow tube member, and said rigid tubular member being threaded on the outer peripheral surface to complementary receive that portion of said spring member not embedded in said upper end portion of said hollow tube member.

5. A fuel dispensing hose assembly as set forth in claim 4 wherein a boot encompasses said coaxial hose adjacent to said upper end portion of said hollow tube member and having a circumferentially extending skirt that overlaps said hollow tube member.

6. A fuel dispensing hose assembly for use with a fuel dispensing pedestal, said pedestal having an upper portion, said hose assembly having a hollow rigid mast mounted on said upper portion of said pedestal, a rigid fuel hose conduit means mounted for rotation in said mast, said rigid conduit means extending outwardly through said mast forming a rigid curved portion, a coupling member mounted at the end of said curved portion, a flexible hose having one end secured to said coupling, the other end of said flexible hose having a fuel dispensing nozzle secured thereto, and said pedestal having means for securing said nozzle in a storage non-use position, said rigid conduit means has a dual passageway, said flexible hose having a pair of passageways therethrough, one of said passageways in said flexible hose interconnecting said fuel dispensing nozzle with one of said dual passageways of said rigid conduit, said fuel dispensing nozzle having a vapor collecting chamber, said chamber communicating with the other one of said passageways in said flexible hose for communication with the other one of said dual passageways, a stop collar is rigidly mounted on said rigid conduit for rotation therewith, said stop collar having a pair of circumferentially spaced stops, and an abutment mounted on said rigid mast operative to selectively engage one or the other of said spaced stops to limit the rotation of said rigid conduit relative to said mast.

7. A fuel dispensing hose assembly as set forth in claim 6 wherein said dual passageways in said rigid conduit is a coaxial conduit with an outer rigid conduit containing an inner concentric rigid conduit.

* * * * *